US010967397B1

(12) United States Patent
Dickie

(10) Patent No.: US 10,967,397 B1
(45) Date of Patent: Apr. 6, 2021

(54) CAULK DISPENSING ASSEMBLY

(71) Applicant: Ted M Dickie, Granbury, TX (US)

(72) Inventor: Ted M Dickie, Granbury, TX (US)

( * ) Notice: Subject to any disclaimer, the term of this patent is extended or adjusted under 35 U.S.C. 154(b) by 0 days.

(21) Appl. No.: 16/848,224

(22) Filed: Apr. 14, 2020

(51) Int. Cl.
*B05C 17/01* (2006.01)

(52) U.S. Cl.
CPC ..... *B05C 17/01* (2013.01)

(58) Field of Classification Search
CPC .... B05C 17/00; B05C 17/01; B05C 17/00533
See application file for complete search history.

(56) References Cited

U.S. PATENT DOCUMENTS 4,850,971 A * 7/1989 Colvin ..... A61M 5/148 604/134
5,435,475 A * 7/1995 Hudson ..... B60R 9/10 224/324
5,499,742 A * 3/1996 Ives, Sr. ..... B65D 35/34 222/101
5,692,645 A * 12/1997 Ryu ..... A47K 5/122 222/101
5,810,205 A * 9/1998 Kohen ..... B65D 35/28 222/103
5,937,628 A * 8/1999 Matechuk ..... B05C 17/002 239/378
6,196,420 B1 * 3/2001 Gutierrez ..... B67D 1/0001 222/101
6,318,596 B1 * 11/2001 Wiesner ..... B65D 35/28 100/210
6,419,121 B1 * 7/2002 Gutierrez ..... B67D 1/0004 222/146.5
6,454,133 B1 * 9/2002 Lopez ..... B65D 35/285 222/102
6,968,978 B1 * 11/2005 Matthews ..... B65D 35/28 222/103
2003/0102327 A1 * 6/2003 Friedman ..... B65D 35/28 222/101

* cited by examiner

*Primary Examiner* — Frederick C Nicolas
(74) *Attorney, Agent, or Firm* — Plager Schack LLP; Mark H. Plager; Michael J. O'Brien

(57) ABSTRACT

A caulk dispensing assembly is configured to dispense caulk in a consistent manner. The caulk dispensing assembly has a bottom plate with a pair of bottom plate rails and bottom plate slot with a bottom plate slot tab. A caulk tube has a caulk tube tip and a caulk tube hanging tab. The caulk tube hanging tab is arranged around the bottom plate slot tab. A top plate is arranged between the pair of bottom plate rails. Sliding the top plate between the pair of bottom plate rails compresses the caulk tube causing caulk to be dispensed from the caulk tube tip in a consistent manner.

4 Claims, 4 Drawing Sheets

CAULK DISPENSING ASSEMBLY

BACKGROUND

The embodiments herein relate generally to construction and civil engineering.

Prior to embodiments of the disclosed invention, mechanically dispensing caulk from small caulk tubes was difficult. In part this had to do with back pressure. As caulk was dispensed from a caulk tube front portion, pressure caused some of the remaining caulk to be pushed into a caulk tube back portion instead of being dispensed. Embodiments of the disclosed invention solve this problem.

SUMMARY

A caulk dispensing assembly is configured to dispense caulk in a consistent manner. The caulk dispensing assembly has a bottom plate with a pair of bottom plate rails and bottom plate slot with a bottom plate slot tab. A caulk tube has a caulk tube tip and a caulk tube hanging tab. The caulk tube hanging tab is arranged around the bottom plate slot tab. A top plate is arranged between the pair of bottom plate rails. Sliding the top plate between the pair of bottom plate rails compresses the caulk tube causing caulk to be dispensed from the caulk tube tip in a consistent manner.

In some embodiments, the upper plate further comprises a pair of upper plate forward tabs and a pair of upper plate rearward tabs. The bottom plate further comprises a bottom plate upper surface arranged between the pair of bottom plate rails, forward of the bottom plate slot, and forward of the bottom plate slot tab; wherein the caulk tube rests upon the bottom plate upper surface. At least one pin, inserted into each of the pair of bottom plate rails between the pair of upper plate forward tabs and a pair of upper plate rearward tabs.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
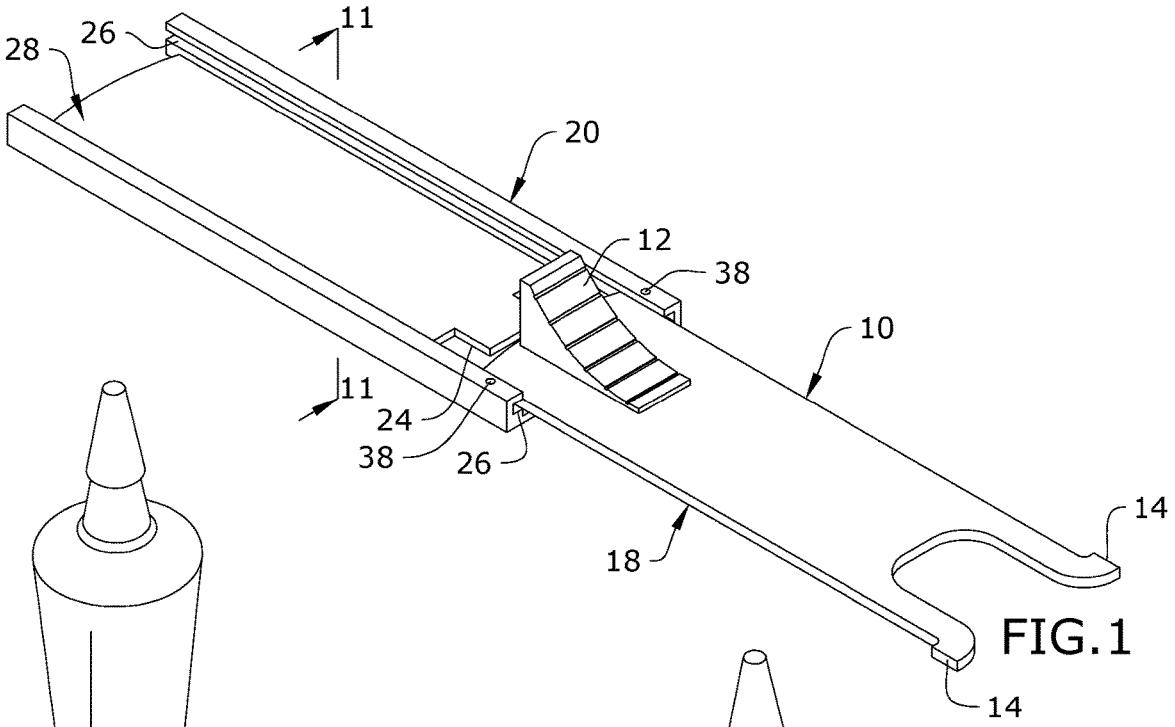
FIG. 1 shows a perspective view of one embodiment of the present invention.
Figure 2:
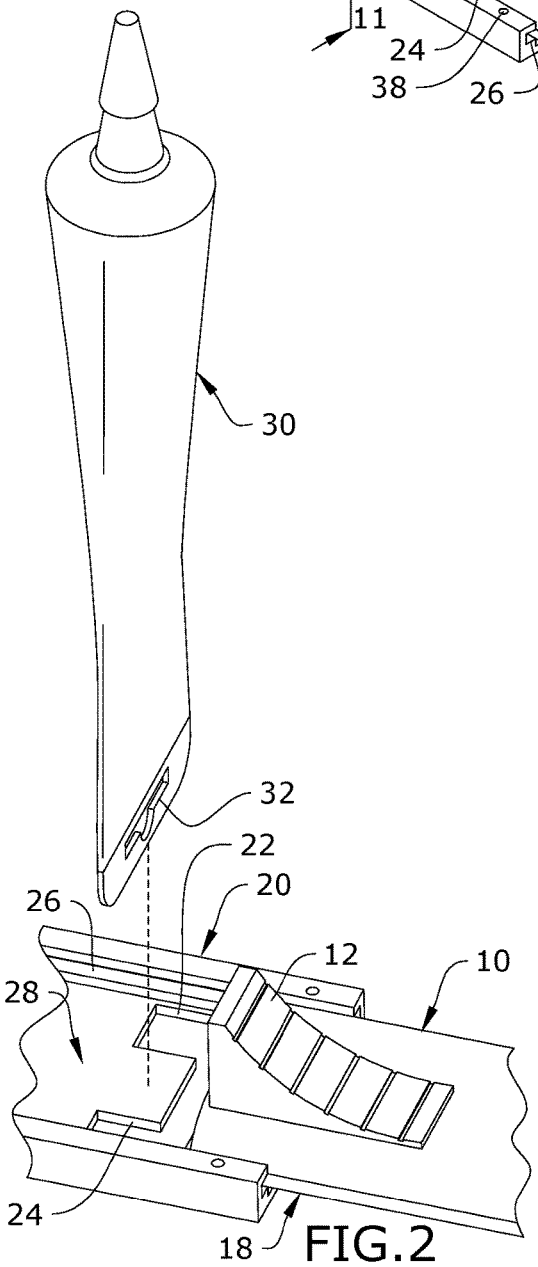
FIG. 2 shows an exploded view of one embodiment of the present invention.
Figure 3:
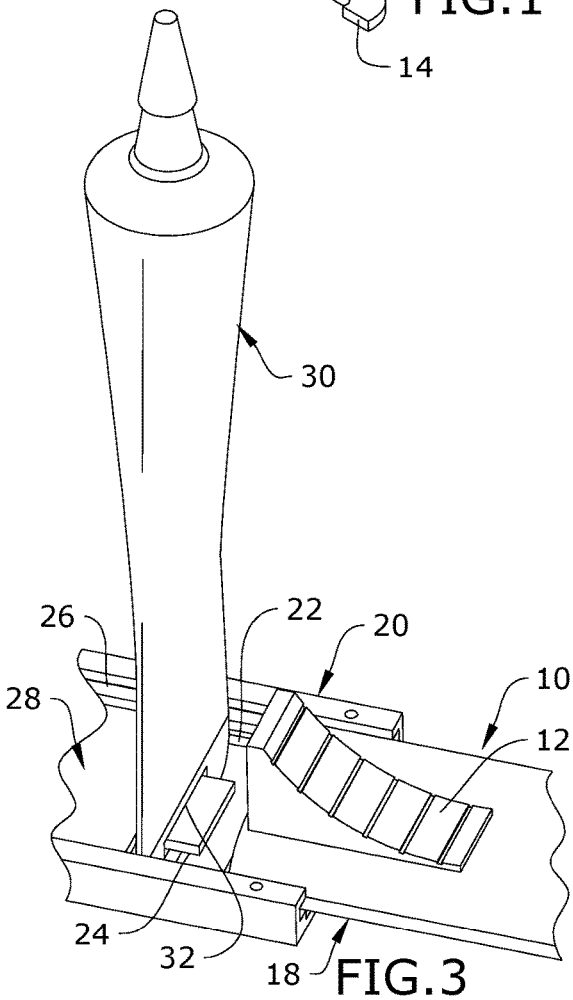
FIG. 3 shows a perspective detail view of one embodiment of the present invention.
Figure 4:
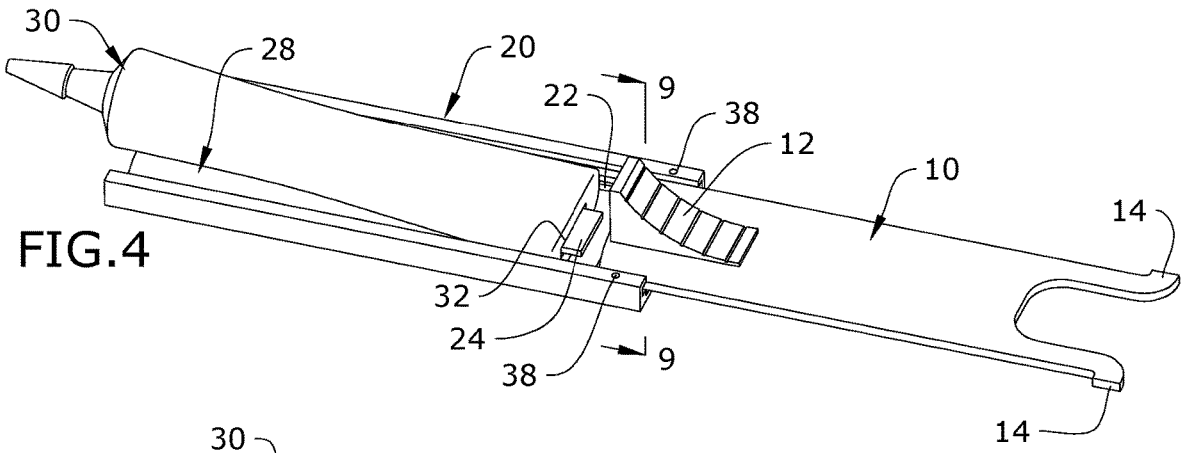
FIG. 4 shows a perspective view of one embodiment of the present invention.
Figure 5:
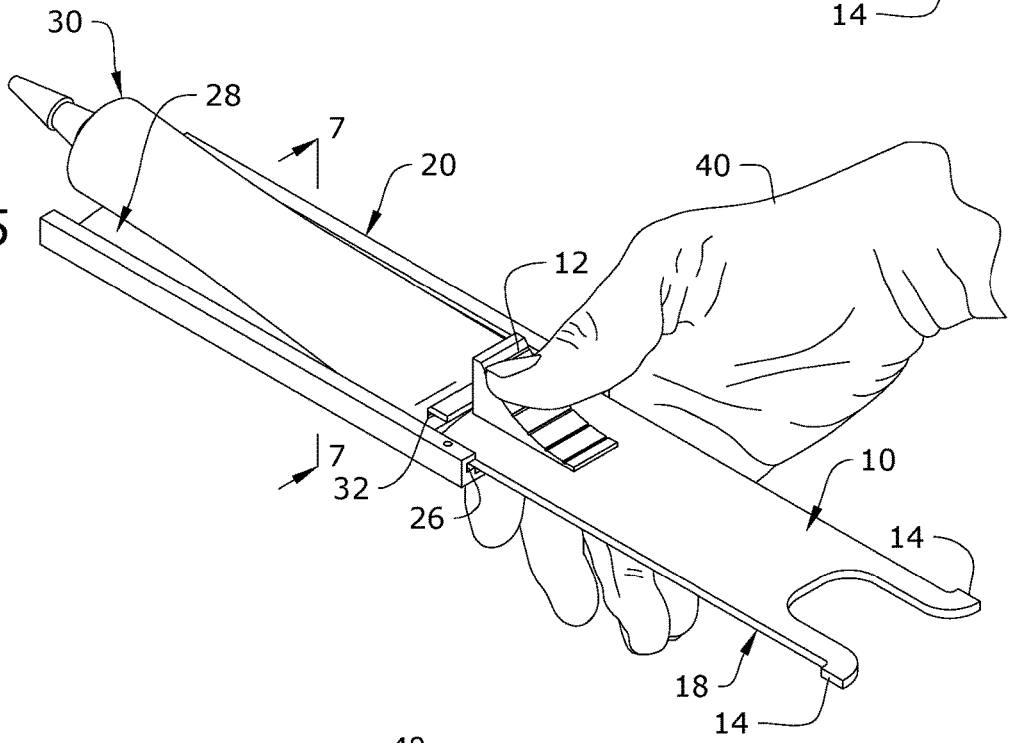
FIG. 5 shows a perspective view of one embodiment of the present invention.
Figure 6:
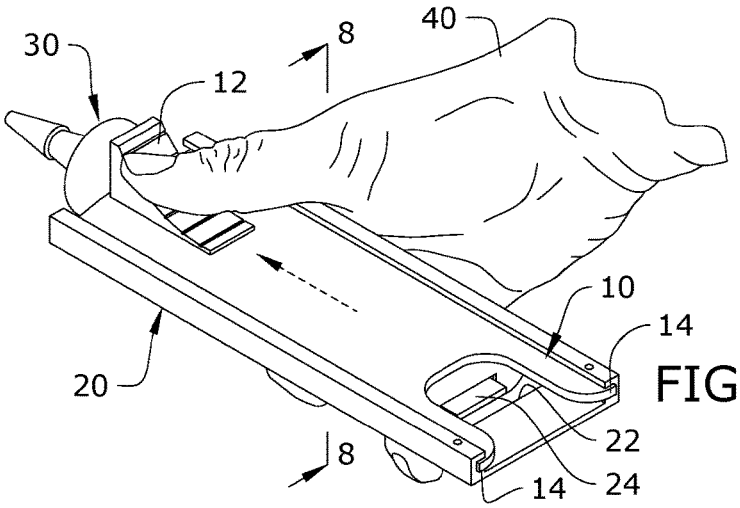
FIG. 6 shows a perspective view of one embodiment of the present invention.
Figure 7:
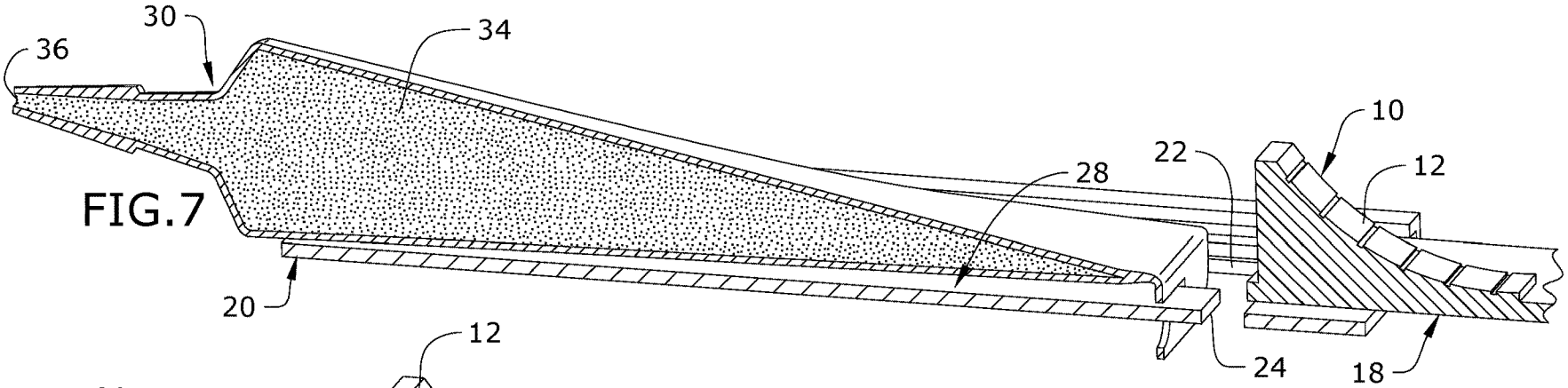
FIG. 7 shows a section view of one embodiment of the present invention taken along line 7-7 in FIG. 5.
Figure 8:
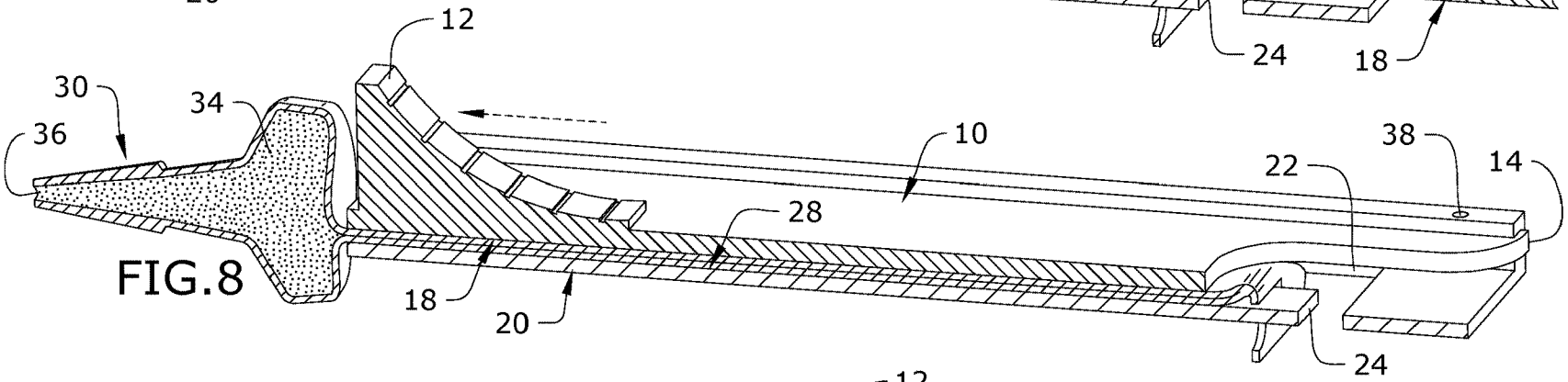
FIG. 8 shows a section view of one embodiment of the present invention taken along line 8-8 in FIG. 6.
Figure 9:
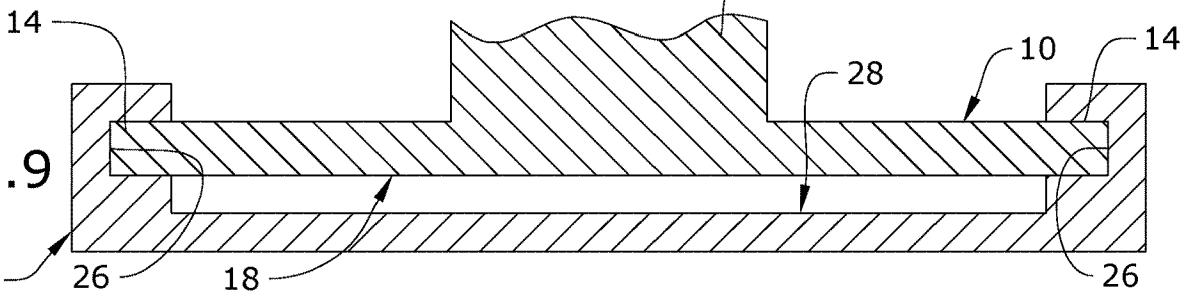
FIG. 9 shows a section view of one embodiment of the present invention taken along line 9-9 in FIG. 4.
Figure 10:
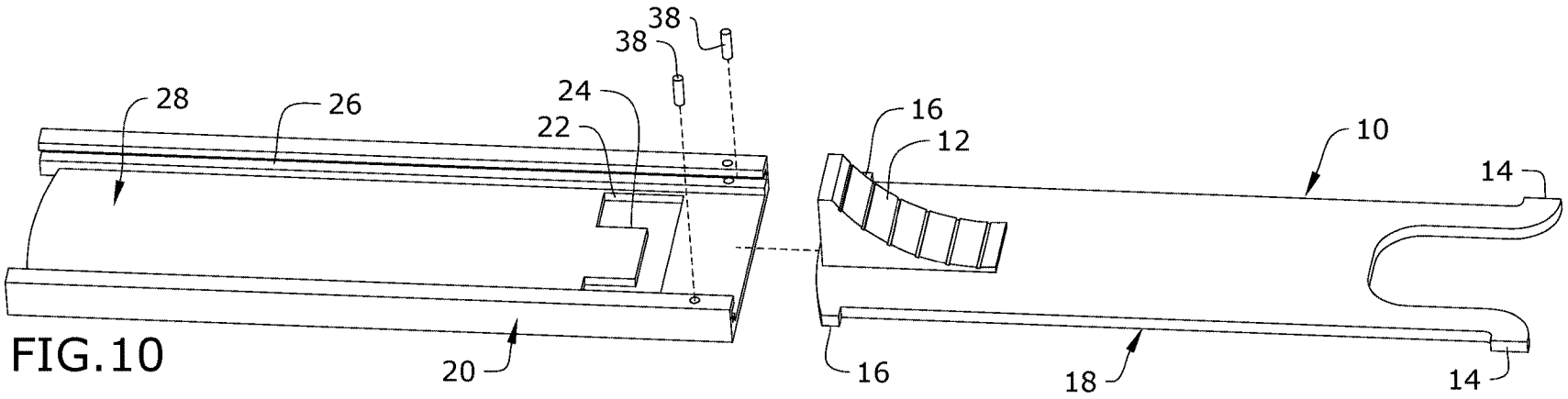
FIG. 10 shows an exploded view of one embodiment of the present invention.
Figure 11:
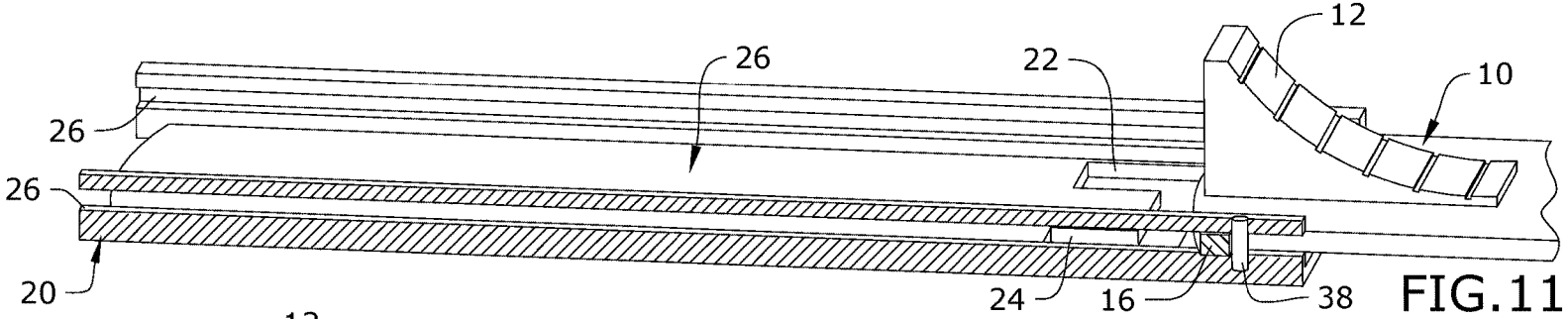
FIG. 11 shows a section view of one embodiment of the present invention taken along line 11-11 in FIG. 1.
Figure 12:
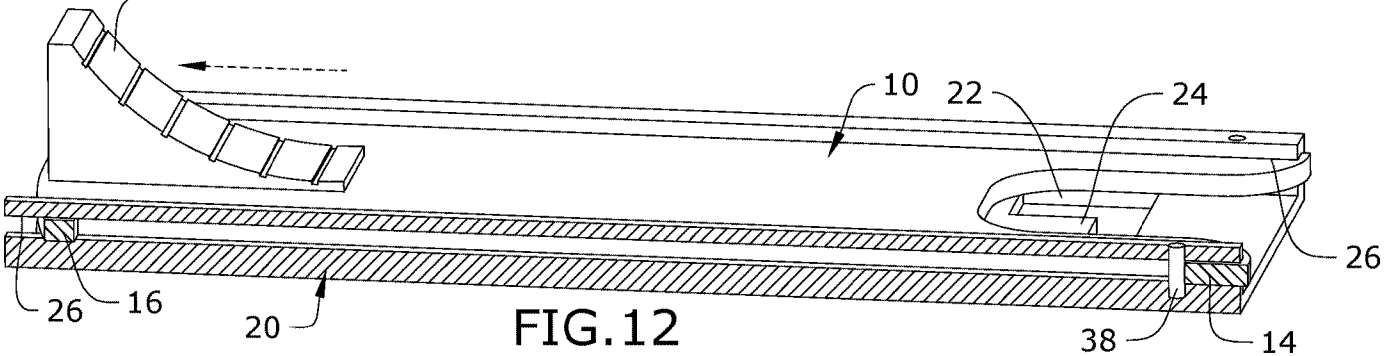
FIG. 12 shows a detail view of one embodiment of the present invention.

By way of example, and referring to FIGS. 1-12, one embodiment of the present system a caulk dispensing assembly comprises an upper plate 10. The upper plate 10 further comprises a push bar 12 arranged at an upper plate forward end. Additionally, at the upper plate forward end is a pair of upper plate forward tabs 16. Similarly, at an upper plate rearward end is a pair of upper plate rearward tabs 14.

The caulk dispensing assembly further comprises a bottom plate 20. The bottom plate 20 further comprises a bottom plate slot 22 that further comprises a bottom plate slot tab 24. The bottom plate 20 further comprises a pair of bottom plate rails 26 through which the upper plate 10 can slide. The bottom plate 20 further comprises a bottom plate upper surface 28 arranged between the pair of bottom plate rails 26 and forward of the bottom plate slot 22 and the bottom plate slot tab 24.

The caulk dispensing assembly further comprises a caulk tube 30. The caulk tube 30 is joined to a caulk tube hanging tab 32 at a caulk tube first end and a caulk tube tip 36 at a caulk tube second end. Caulk 34 fills the caulk tube between the caulk tube first end and the caulk tube second end.

Once at least some of the upper plate 10 slides into the bottom plate slot 22, the user 40 can insert a plurality of pins 38 through the bottom plate slot 22 so that the top plate slot only slides between the pair of upper plate forward tabs 16 and the pair of upper plate rearward tabs 14.

To use the device, the caulk tube hanging tab 32 is arranged around the bottom plate slot tab 24. Then, the caulk tube 30 is arranged against the bottom plate upper surface 28. After that, a user 40, can push the push bar 12 from a bottom plate rearward end to a bottom plate forward end. This compresses the caulk tube 30 causing caulk 34 to be dispensed from the caulk tube 30 through the caulk tube tip 36 while leaving a caulk tube rear portion under vacuum.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A caulk dispensing assembly, configured to dispense caulk in a consistent manner; the caulk dispensing assembly comprising:

a bottom plate, further comprising a pair of bottom plate rails and bottom plate slot with a bottom plate slot tab;

a caulk tube further comprising a caulk tube tip and a caulk tube hanging tab; wherein the caulk tube hanging tab is arranged around the bottom plate slot tab;

a top plate, arranged between the pair of bottom plate rails;

wherein sliding the top plate between the pair of bottom plate rails compresses the caulk tube causing caulk to be dispensed from the caulk tube tip in a consistent manner.

2. The caulk dispensing assembly of claim 1, wherein the upper plate further comprises a pair of upper plate forward tabs and a pair of upper plate rearward tabs.

3. The caulk dispensing assembly of claim 2, wherein the bottom plate further comprises a bottom plate upper surface arranged between the pair of bottom plate rails, forward of the bottom plate slot, and forward of the bottom plate slot tab; wherein the caulk tube rests upon the bottom plate upper surface.

4. The caulk dispensing assembly of claim 2, further comprising at least one pin, inserted into each of the pair of bottom plate rails between the pair of upper plate forward tabs and a pair of upper plate rearward tabs.

* * * * *